US010687151B2

(12) United States Patent
Petersen et al.

(10) Patent No.: US 10,687,151 B2
(45) Date of Patent: Jun. 16, 2020

(54) HEARING AID DEVICE INCLUDING A SELF-CHECKING UNIT FOR DETERMINE STATUS OF ONE OR MORE FEATURES OF THE HEARING AID DEVICE BASED ON FEEDBACK RESPONSE

(71) Applicant: Oticon A/S, Smørum (DK)

(72) Inventors: Svend Oscar Petersen, Smørum (DK); Thor Højlund Olsen, Smørum (DK); Kåre Tais Christensen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/112,089

(22) Filed: Aug. 24, 2018

(65) Prior Publication Data

US 2019/0069096 A1 Feb. 28, 2019

(30) Foreign Application Priority Data

Aug. 25, 2017 (EP) ..... 17187890

(51) Int. Cl.
*H04R 25/00* (2006.01)
*H04R 1/08* (2006.01)

(52) U.S. Cl.
CPC ..... *H04R 25/305* (2013.01); *H04R 1/08* (2013.01); *H04R 25/453* (2013.01); (Continued)

(58) Field of Classification Search
USPC ..... 381/92, 93, 94.9, 95, 96, 108, 121, 83
See application file for complete search history.

(56) References Cited

FOREIGN PATENT DOCUMENTS

EP 1708543 A1 10/2006
EP 2613566 * 3/2012 ..... H04R 25/00
(Continued)

*Primary Examiner* — Yosef K Laekemariam
(74) *Attorney, Agent, or Firm* — Birch, Stewart, Kolasch & Birch, LLP

(57) ABSTRACT

The disclosure present a method for determining a status of one or more features of a hearing aid device and a hearing system, wherein the hearing system includes the hearing aid device, and the hearing aid device comprises a housing part, a connection part and an ear piece connected via the connection part to the housing part, and wherein the hearing aid device comprising; a first microphone configured to receive a first acoustic signal and provide a first audio signal based on the first acoustic signal, a signal processor connected to the first microphone and configured to receive the first audio signal and provide an output audio signal based on the first audio signal, a speaker configured to receive the output audio signal and output an acoustic output signal via the ear piece, an anti-feedback unit configured to receive the output audio signal from the signal processor and a secondary first audio signal from the first microphone, and the anti-feedback unit is further configured to estimate a first feedback response of a feedback path from the speaker to the first microphone based on a feedback estimate and the received secondary first audio signal and the output audio signal, and wherein the hearing system includes a self-checking unit configured to communicate with the anti-feedback unit, and the self-checking unit is configured to compare the first feedback response with a first feedback input signal, and the hearing system is configured to determine a status of one or more features in the hearing aid device based on the comparison between the first feedback response and the first feedback input signal.

17 Claims, 6 Drawing Sheets

(52) U.S. Cl.
CPC ..... *H04R 25/505* (2013.01); *H04R 25/558* (2013.01); *H04R 25/604* (2013.01); *H04R 25/654* (2013.01); *H04R 2225/55* (2013.01)

(56) References Cited

FOREIGN PATENT DOCUMENTS

| | | | |
|---|---|---|---|
| EP | 2613566 | A1 | 7/2013 |
| EP | 2869600 | A1 | 5/2015 |
| EP | 3086574 | A2 | 10/2016 |
| EP | 3086574 | A3 | 3/2017 |

* cited by examiner

HEARING AID DEVICE INCLUDING A SELF-CHECKING UNIT FOR DETERMINE STATUS OF ONE OR MORE FEATURES OF THE HEARING AID DEVICE BASED ON FEEDBACK RESPONSE

TECHNICAL FIELD

The disclosure relates to a hearing aid device and a hearing system which is configured to determine a status of one or more features of the hearing aid device based on feedback response.

BACKGROUND

Many hearing aid device users are not aware if there is a problem with their device like if the wax filter in the speaker unit is blocked with wax, their battery is flat, the speaker unit Is broken, or if the hearing aid device is placed at the proper position in the ear canal.

Additionally, the users often complain or return their instruments to the HCP or to the manufacture of the hearing aid device, even if there is no real hardware error, like if the wax filter needs changing.

So it would be beneficial if the user himself could test whether the hearing aid is working properly, and if not, then get information of what the actual problem with the instrument is.

SUMMARY

An object of the present disclosure is to provide a hearing system including a hearing aid device, where the hearing aid device itself is configured to perform a self-check of the configuration or functionality of the hearing aid device for the purpose of providing a status of one or more features in the hearing aid device.

The one or more features could for example be a microphone or a speaker of the hearing aid device.

A further object of the present disclosure is to inform the status of the hearing aid device to the user of the hearing aid device and/or a hearing care professional.

Objects of the present disclosure are achieved by the present disclosure described in the accompanying claims and as described in the following.

An object of the present disclosure is achieved by a hearing system including a hearing aid device, wherein the hearing aid device comprises a housing part, a connection part and an ear piece connected via the connection part to the housing part, and wherein the hearing aid device comprising; a first microphone configured to receive a first acoustic signal and provide a first audio signal based on the first acoustic signal, a signal processor connected to the first microphone and configured to receive the first audio signal and provide an output audio signal based on the first audio signal, a speaker configured to receive the output audio signal and output an acoustic output signal via the ear piece, an anti-feedback unit configured to receive the output audio signal from the signal processor and a secondary first audio signal from the first microphone, and the anti-feedback unit is further configured to estimate a first feedback response of a feedback path from the speaker to the first microphone based on a feedback estimate and the received secondary first audio signal and the output audio signal, and wherein the hearing system includes a self-checking unit configured to communicate with the anti-feedback unit, and the self-checking unit is configured to compare the first feedback response with a first feedback input signal, and the hearing system is configured to determine a status of one or more features in the hearing aid device based on the comparison between the first feedback response and the first feedback input signal.

The first feedback input signal may comprise one or more measurements at one or more frequencies of a feedback response of a feedback path.

The hearing aid device is a Behind-The-Ear hearing aid device where the housing part is positioned behind the ear of the user of the hearing aid, and ear piece is positioned in the ear canal of the user, and the connection part is connecting the ear piece with the housing part. The connection part may be a hollow tube configured to transport the acoustic output signal to the ear of the user. Alternatively, the connection part may be a hollow tube including multiple wires, where each of the wires is connecting a microphone and/or a speaker within the ear piece to the signal processor within the housing part.

An example of a use of the hearing system, the hearing aid device is being worn by the user as prescribed, i.e. the ear piece is positioned within the ear canal of the user and the housing part is positioned behind the ear of the user, the first microphone receives then the first acoustic signal from the surroundings and generates the first audio signal on the acoustic signal. The signal processor which is connected to the first microphone receives the first audio signal and generates the output audio signal based on the first audio signal. The speaker is connected to the signal processor and receives the output audio signal and output the acoustic output signal via the ear piece and into the ear of the user. Due to leakage problem between the ear piece and the ear canal, some of the acoustic output signal emitted by the speaker will be received by the first microphone creating a feedback between the speaker and the first microphone. This feedback is used for determining a status of the functionality of for example the first microphone and/or the speaker. In order to determine the feedback, the hearing aid device uses the anti-feedback unit. The anti-feedback unit in the hearing aid device receives the output audio signal from the signal processor and the secondary first audio signal from the first microphone. The output audio signal is generated based on the first acoustic signal received by the first microphone at time t1 and the secondary first audio signal is generated based on a second acoustic signal received by the first microphone at time t2. The anti-feedback unit estimates a first feedback response of the feedback path from the speaker to the first microphone based on the feedback estimate, i.e. a feedback algorithm, and the received secondary first audio signal and the output audio signal. In order to use the estimated first feedback response for determine the status of one or more features in the hearing aid device, the hearing system uses the self-checking unit which is configured to communicate with the anti-feedback unit. The self-checking unit compares the first feedback response with the first feedback input signal, and the hearing system is then configured to determine the status of one or more features of the hearing aid device based on the comparison between the first feedback response and the first feedback input signal.

The self-checking unit can be included in the hearing aid device or a smartphone being part of the hearing system.

The hearing system is then able determine the status of for example the first microphone and the speaker of the hearing aid device based on the comparison between the first feedback response and the first feedback input signal.

The advantage of the hearing system is that the user is informed about the status of one or more features in hearing aid device, and the status may for example inform the user about a defect or a possible defect which may soon occur in one or more features, e.g. the first microphone, the speaker, a wax filter and/or a battery within the hearing aid device.

The hearing system may comprise a user interface which informs the user about the status and/or informs the user with guidance towards a solution to the defect or towards a solution which prevents the possible defect.

The advantage with the hearing system is that the user will experience a hearing aid device with less defects.

The ear piece may comprise a vent characterized as having a vent internal response having a −3 dB cut-off frequency around or above 800 Hz, or between 800 HZ and 1600 HZ. The vent internal response is the difference between a sound pressure level when the vent is open and closed.

The hearing system may comprise a memory unit including the first feedback input signal, where the first feedback input signal may be a pre-measure of a feedback response of the feedback path from the speaker to the first microphone or a threshold value(s).

The memory unit may be part of the hearing aid device or an auxiliary device configured to communicate with the hearing aid device via a wireless communication link, such as a Bluetooth link, low energy Bluetooth link or an inductive link. The auxiliary device may be a smartphone, and/or a wireless mobile device configured to be wearable by the user of the hearing aid device.

The memory unit may be part of a server communicating with either the hearing aid device or the auxiliary device via a communication link, such as a long range link or a short range link.

The self-checking unit may be configured to store the result of the comparing between the first feedback response with the first feedback input signal into the memory unit, or the hearing system is configured store the status of one or more features of the hearing aid device into the memory unit.

The first feedback input signal may be a pre-measure of the feedback response of the feedback path. The pre-measure may be performed when the user is wearing the hearing aid device as prescribed, and when the hearing aid device is in an ideal condition. The ideal condition is for example when the battery is fully charged, a wax filter in the ear piece has no wax, the first microphone and the speaker are fulfilling specifications set by either the manufacture of the microphone, the speaker and/or the hearing aid device. Therefore, the first feedback input signal represents an ideal feedback response where the hearing aid device is functioning as prescribed by the manufacture of the hearing aid device.

The hearing aid device may comprise a second microphone configured to receive a second acoustic signal and provide a second audio signal, and the signal processor receives the second audio signal, and the signal processor may further be configured to provide the output audio signal based on the first audio signal and the second audio signal, and the anti-feedback unit may further be configured to receive a secondary second audio signal from the second microphone and the output audio signal and to estimate a second feedback response of a second feedback path from the speaker to the second microphone based on a second feedback estimate, the secondary second audio signal and the output audio signal, and where the second feedback response is the first feedback input signal.

If for example the second microphone is positioned in the housing part and the first microphone is positioned in the ear piece, then the hearing aid device is configured to provide a status on whether the ear piece is missing a seal element which is configured to seal between the ear piece and the ear canal, or to provide a status on whether the wax filter or the inlet, located in the ear piece to protect for example the speaker for ear wax, is blocked.

If for example the second microphone is positioned in the housing part and the first microphone is positioned in the housing part, then the hearing aid device is configured to provide a status on whether an inlet to either the first or the second microphone is blocked.

The advantage of having the second microphone is that if a microphone inlet to one of the microphones is blocked or if one of the microphone gets an error, then this can be detected via the comparison between the first feedback response and the first feedback input signal.

For the hearing system to determine whether the wax filter in the ear piece is ok or the inlet to the first and to the second microphone is ok, the self-checking unit is configured to compare the first feedback response and the first feedback input signal. The comparison comprises following items;

- determining within a first frequency range a first maximum signal level of the signal level of the first feedback response and a first maximum reference level of the signal level of the first feedback input signal and/or the second feedback input signal,
- determining within a second frequency range a second maximum signal level of the signal level of the first feedback response and a second maximum reference level of the signal level of the first feedback input signal and/or the second feedback input signal,
- determining a first signal level difference between the first maximum signal and the first maximum reference level,
- determining a second signal level difference between the second maximum signal and the second maximum reference level.

The first signal level difference may be greater than −2, −4 or −6 dB and the second level difference may be great than −3, −5 or −7 dB, and the first frequency range is between 2.5 kHz and 3.5 kHz, and the second frequency range is between 7.5 kHz and 8.5 kHz, and where the status of the wax filter is ok.

The performance of determine whether the wax filter is occluded or whether the ear piece is missing is improved when the ear piece has a vent internal response having a −3 dB cut-off frequency around or above 800 Hz, or between 800 HZ and 1600 HZ.

The hearing aid device may further comprise a signal generator configured to provide a generated audio signal, and a combiner connected to the signal generator and the signal processor. The combiner may be configured to combine the generated audio signal into the output audio signal, and where the output audio signal is transmitted to the anti-feedback unit. The signal generator may be enabled to emit white noise or a stepped sinus signal, to improve the first feedback response estimated by the anti-feedback unit. Thereby, the determination of the status of the one or more features in the hearing aid device becomes more accurate.

The self-checking unit may be located within the hearing aid device, and wherein the hearing aid device is configured to communicate an information signal based on the comparing between the first feedback response and the first feedback input signal to a user interface of the hearing aid device, or the hearing system comprises a mobile device, wherein the information signal is communicated to the mobile device via a wireless link. In this example, the hearing aid device may comprise a front end which includes a transceiver and an antenna configured to communicate wirelessly with for example the mobile device.

The information signal may comprise a diagnose of the one or more features in the hearing aid device based on the status of the one or more features. The diagnose may for example be;

Faulty speaker sensitivity;

Critical amount of wax in the wax filter of the speaker and/or the microphone (if located in the ear piece);

Missing waxfilter or sealer;

Faulty microphone(s) or blocked microphone inlet(s);

Position of the ear piece in ear canal is not correct;

Wrong Speaker unit type detection;

Wrong sealer type—try a new sealer which fits the user better;

The mobile device may be a smartphone or an auxiliary device, such as an intermediate audio streaming device. The wireless link may be a short range link, such as Bluetooth, Bluetooth low energy or an inductive link, or the wireless link may have a working frequency range between 300 MHz and 6 GHz.

The hearing system may include a mobile device, wherein the mobile device comprises the self-checking unit, and wherein the mobile device is configured to communicate an information signal comprising the status of one or more features in the hearing aid device to a user interface of the mobile device 51 or to a user interface of the hearing aid device. In this example the hearing aid device may comprise the front end. Via the front end the hearing aid device may transmit the first feedback response and/or the first feedback input signal to the mobile device, and the mobile device is then configured to do the comparing between the first feedback response and the first feedback input signal and provide the information signal to a user interface in the mobile device. The mobile device may be configured to transmit the information signal or the status of the one or more features to the hearing aid device, and the hearing aid device may be configured to inform the user about the status or the content of the information signal via a user interface in the hearing aid device.

The advantage of having the self-checking unit in the mobile device is that the hearing aid device will save battery power due to less burden on the signal processor since fewer calculations are going to be performed by the signal processor compared to the example when the self-checking unit is located in the hearing aid device.

The mobile device and/or the hearing aid device may be configured to transmit the status of the hearing aid device (i.e. of the one or more features) and/or the information signal to a server via an internet connection or a long range communication link. Via the server, a service provider may be able to receive the status and/or the information signal via a computer connected to the server and provide guidance to the user of the relevant hearing aid device on how to solve the problem which is indicated via the information signal and/or the service provider may be able to order for example a new microphone, a new wax filter or a new battery and/or a speaker for replacing the features in the hearing aid device, if the information signal indicates that one of the features is defect.

Additionally, the service provider may be able to plan a service of the hearing aid device before any problems will occur since the information in the status may indicate that soon one of the features in the hearing aid device is going to break down or create an error in the hearing aid device.

The advantage of being able to inform a service provider of the status and/or the information signal of the hearing aid device is that the user of the hearing aid device will experience less problems with the hearing aid device and/or a more comfortable way to solve problems regarding the hearing aid device. Thereby, the user will achieve an improved experience with the hearing aid device.

The comparing between the first feedback response with the first feedback input signal includes determining within one or more frequency ranges or at one or more frequencies a signal level difference between the first feedback response and the first feedback input signal.

The comparing between the first feedback response and the first feedback input signal including;

determining within a first frequency range a first average signal level of the signal level of the first feedback response and a first average reference level of the signal level of the first feedback input signal, determining within a second frequency range a second average signal level of the signal level of the first feedback response and a second average reference level of the signal level of the first feedback input signal, determining within a third frequency range a third average signal level of the signal level of the first feedback response and a third average reference level of the signal level of the first feedback input signal, determining a first absolute signal level difference between the first average signal and the first average reference level, determining a second absolute signal level difference between the second average signal and the second average reference level, and determining a third absolute signal level difference between the third average signal and the third average reference level.

The second absolute signal level difference may be between 0 dB and 2 dB or 0 dB and 4 dB, and the first absolute signal level difference and the third absolute signal level difference may both be between 2 dB and 10 dB, 3 dB and 10 dB, or 2 dB and 9 dB, and where the first frequency range may be between 2 and 5 kHz, the second frequency range may be between 5 and 7 kHz and the third frequency range may be between 7 and 8 kHz. The status provided by the comparing indicates whether the positioning of the ear piece is correct or not correct. If the criteria given for the first, second and third absolute signal level difference and for the first, second and third frequency range are met then the ear piece is positioned correctly in the ear canal.

The comparing between the first feedback response with the first feedback input signal may include; determining within a first frequency range a first maximum signal level of the signal level of the first feedback response and a first maximum reference level of the signal level of the first feedback input signal and/or the second feedback input signal, determining within a second frequency range a second maximum signal level of the signal level of the first feedback response and a second maximum reference level of the signal level of the first feedback input signal and/or the second feedback input signal, determining a first absolute signal level difference between the first maximum signal and the first maximum reference level, determining a second absolute signal level difference between the second maximum signal and the second maximum reference level.

The comparing between the first feedback response with the first feedback input signal determines the status of the one or more features in the hearing aid device, where in this example the status informs whether the wax filter or an inlet to the speaker and/or to the microphone(s) is occluded.

The wax filter is not ok if following conditions are not meet;

the first signal level difference is less than 2 dB, 3 dB or 6 dB and the second absolute level difference is less than −3 dB, −5 dB or −7 dB, and the first frequency range may be between 2.5 kHz and 3.5 kHz, and the second frequency range may be between 7.5 kHz and 8.5 kHz.

The self-checking unit may be configured to perform following steps in order provide a status on the speaker type connected;

determining within a first frequency range a first maxima signal level of the signal level of the first feedback response, and the first frequency range is at 3 kHZ+/−0.5 kHz, determining within a second frequency range a second maxima signal level of the signal level of the first feedback response, and the second frequency range is at 5 kHZ+/−0.5 kHz, determining within a third frequency range a third maxima signal level of the signal level of the first feedback response, and the third frequency range is at 8 kHZ+/−0.5 kHz.

The status of the speaker determines the type of the speaker in the hearing aid device, and where the types of speakers are divided into at least three groups of speaker types:

a first group of speaker types if the first maxima signal level is between −10 dB and −30 dB, the second maxima signal level is below −15 dB, and the third maxima signal level is below −20 dB, a second group of speaker types if the first maxima signal level is between −10 dB and −30 dB, the second maxima signal level is below −15 dB, and the third maxima signal level is between −10 dB and −20 dB, or a third group of speaker types if the second maxima signal level is between 0 dB and −15 dB and the third maxima signal 41C is between −20 dB and −30 dB.

If for example the speaker is to be replaced with a new speaker, then the hearing system is configured to determine whether this new speaker is the correct type, and the hearing system is further configured to detect whether the speaker is functioning A further object of the present disclosure is achieved by a method for determining a status of one or more features in a hearing aid device, the method comprising;

receiving a first acoustic signal via a first microphone and outputting a first audio signal based on the first acoustic signal, processing the first audio signal via a signal processor and providing an output audio signal based on the first audio signal, receiving the output audio signal via a speaker and outputting an acoustic output signal based on the output audio signal, receiving the output audio signal from the processor and a secondary first audio signal from the first microphone, estimating a first feedback response of a feedback path from the speaker to the first microphone based on a feedback estimate and the received secondary first audio signal and the output audio signal, comparing the first feedback response with a first feedback input signal, determining a status of the configuration of the hearing aid device based on the comparison between the first feedback response with the first feedback input signal.

The determination of the status of the one or more features in the hearing aid device is performed when either the hearing aid device is positioned on a table or is worn by a user.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1A:
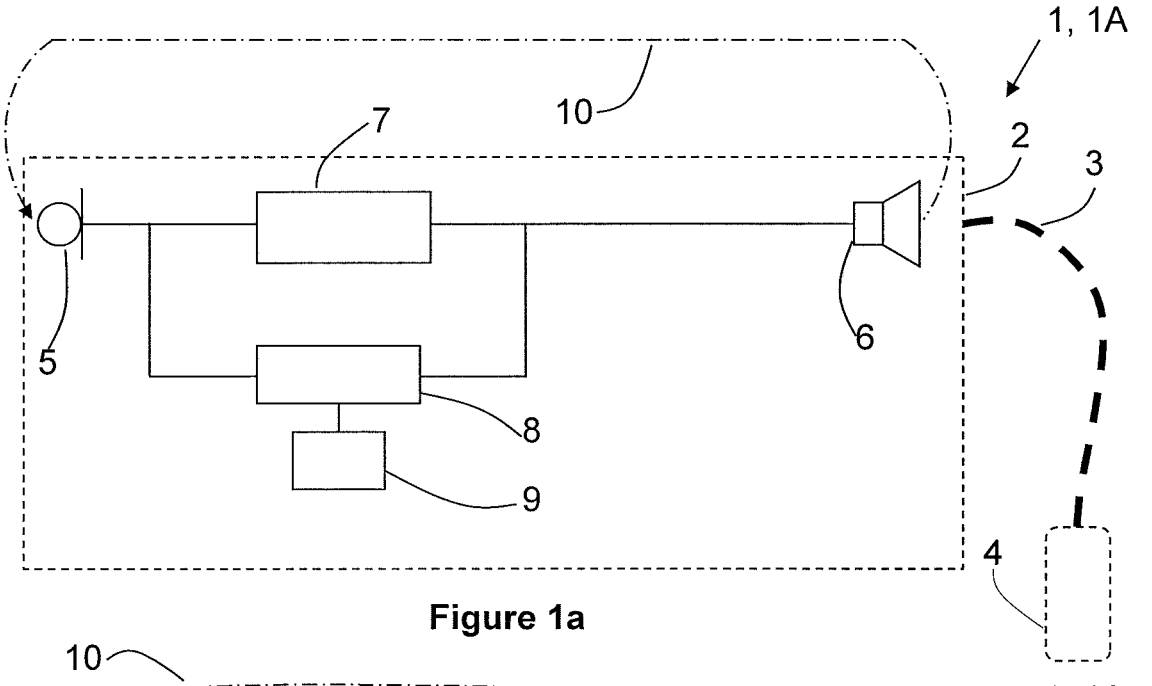
FIGS. 1*a* to 1*c*, illustrate three different examples of the hearing system.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

A hearing aid device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears.

The hearing aid device is adapted to be worn in any known way. This may include i) arranging a unit of the hearing aid device behind the ear with a tube leading air-borne acoustic signals or with a receiver/loudspeaker arranged close to or in the ear canal such as in a Behind-the-Ear type hearing aid or a Receiver-in-the Ear type hearing aid, and/or ii) arranging the hearing aid device entirely or partly in the pinna and/or in the ear canal of the user such as in a In-the-Ear type hearing aid or In-the-Canal/Completely-in-Canal type hearing aid, or iii) arranging a unit of the hearing aid device attached to a fixture implanted into the skull bone such as in Bone Anchored Hearing Aid or Cochlear Implant, or iv) arranging a unit of the hearing aid device as an entirely or partly implanted unit such as in Bone Anchored Hearing Aid or Cochlear Implant.

A hearing aid device may be part of a "hearing system", which refers to a system comprising one or two hearing aid devices, disclosed in present description, and a "binaural hearing system" refers to a system comprising two hearing aid devices where the devices are adapted to cooperatively provide audible signals to both of the user's ears. The hearing system or binaural hearing system may further include auxiliary device(s) that communicates with at least one hearing aid device, the auxiliary device affecting the operation of the hearing aid devices and/or benefitting from the functioning of the hearing aid devices. A wired or wireless communication link between the at least one hearing aid device and the auxiliary device is established that allows for exchanging information (e.g. control and status signals, possibly audio signals) between the at least one hearing aid device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing aid device. The remote control is adapted to control functionality and operation of the at least one hearing aid devices. The function of the remote control may be implemented in a SmartPhone or other electronic device, the SmartPhone/electronic device possibly running an application that controls functionality of the at least one hearing aid device.

In general, a hearing aid device includes i) an input unit such as a microphone for receiving an acoustic signal from a user's surroundings and providing a corresponding input audio signal, and/or ii) a receiving unit for electronically receiving an input audio signal. The hearing aid device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing aid devices, the output unit may include one or more output electrodes for providing the electric signals such as in a Cochlear Implant.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follows.

Figure 1B:
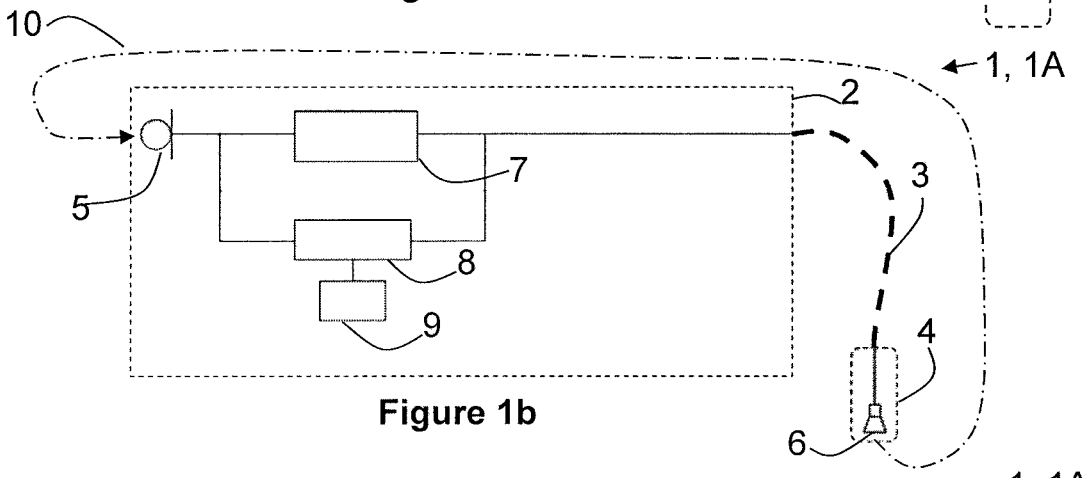
Figure 1C:
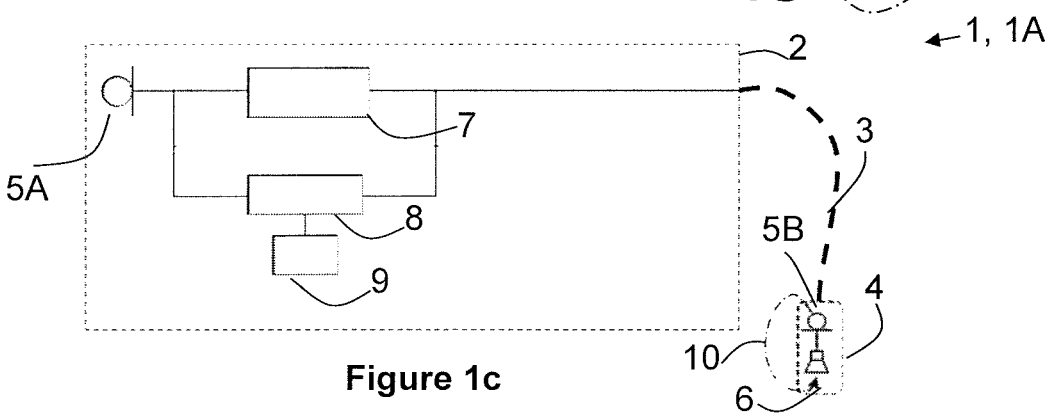

FIGS. 1*a* to 1*c* illustrates three different examples of the hearing system 1. The hearing system 1 in the three examples includes a hearing aid device 1A which comprises a housing part 2, a connection part 3 and an ear piece 4 connected via the connection part 4 to the housing part 2. The hearing aid device 1A comprises a first microphone 5 configured to receive a first acoustic signal and provide a first audio signal based on the first acoustic signal. The hearing aid device 1A comprises a signal processor 7 connected to the first microphone 5 and configured to receive the first audio signal and provide an output audio signal based on the first audio signal. Additionally, the hearing aid device 1A comprises a speaker 6 configured to receive the output audio signal and output an acoustic output signal via the ear piece 4, and furthermore, the hearing aid device 1A comprises an anti-feedback unit 8 configured to receive the output audio signal from the signal processor 7 and a secondary first audio signal from the first microphone 5, and the anti-feedback unit 8 is configured to estimate a first feedback response of a feedback path 10 from the speaker 6 to the first microphone 5 based on a feedback estimate and the received secondary first audio signal and the output audio signal. The hearing system 1 includes a self-checking unit 9 configured to communicate with the anti-feedback unit 8, and the self-checking unit 9 is configured to compare the first feedback response with a first feedback input signal, and the hearing system 1 is configured to determine a status of one or more features in the hearing aid device 1A based on the comparison between the first feedback response and the first feedback input signal.

In FIGS. 1*a* to 1*c* the self-checking unit 9 is positioned within the hearing aid device 1A, however, the self-checking unit 9 could be positioned distantly from the hearing aid device 1A, for example within a mobile device, in a server or in a computer.

FIG. 1*a* illustrates the hearing aid device 1A wherein the first microphone 5 and the speaker 6 are positioned within the housing part 2. The connection part 3 in this specific example illustrated in FIG. 1*a* is a hollow tube configured to transmit the acoustic output signal from the speaker 6 via the air inside the hollow tube.

FIG. 1*b* illustrates the hearing aid device 1A where the first microphone 5 is positioned within the housing part 2 and the speaker 6 is positioned within the ear piece 4. The ear piece 4 may comprise an wax filter 15 (not shown in this figure) for preventing the speaker 6 to be occluded with dirt from the ear, such as ear wax. The wax filter may be positioned in front of the speaker. A second wax filter may be positioned in front of the microphone positioned within the ear piece.

FIG. 1*c* illustrates the hearing aid device 1A comprising a first microphone 5A and a second microphone 5B. In this specific example, the first microphone 5A is positioned within the housing part 2 and the second microphone 5B is positioned within the ear piece 4 together with the speaker 6.

In another example both microphones (5A, 5B) may be positioned within the housing part 2 or within the ear piece 4.

Figure 2:
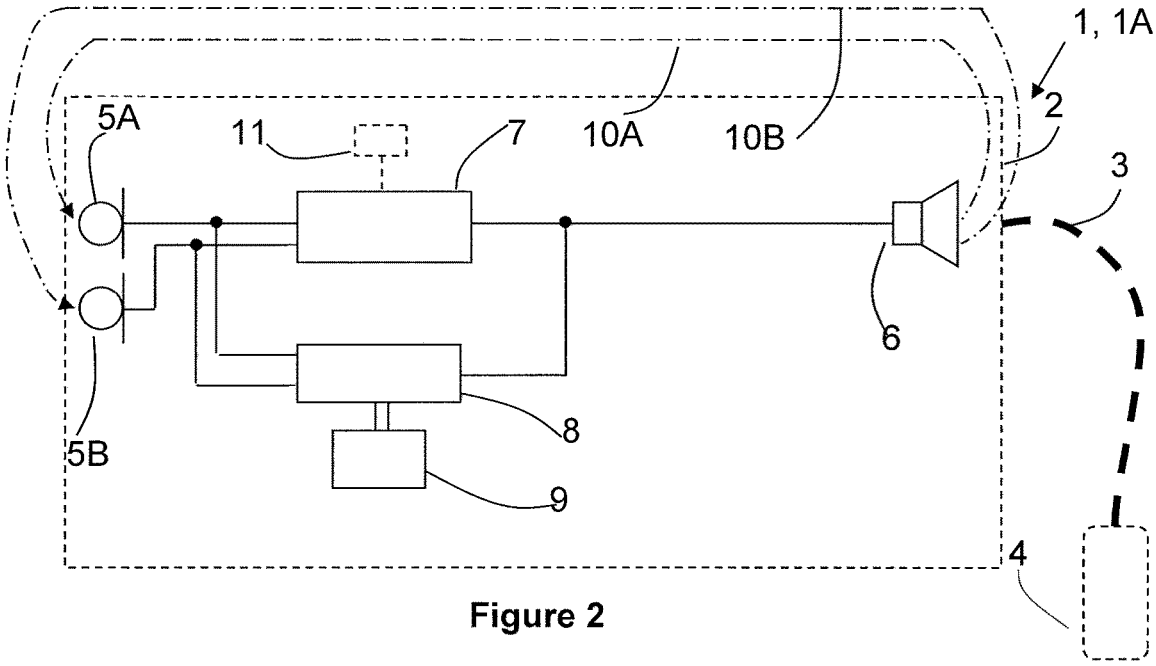
FIG. 2, illustrates the hearing system comprising the hearing aid device.

FIG. 2 illustrates the hearing system 1 comprising the hearing aid device 1A. In this specific example, the hearing aid device 1A comprises the memory unit 11 which includes the first feedback input signal. The first feedback input signal may be a pre-measure of a feedback response of the feedback path (10, 10A, 10B) from the speaker 6 to the first microphone 5. Furthermore, in this specific example the hearing aid device 1A comprises the first microphone 5A and the second microphone 5B within the housing part 2. The second microphone 5B is configured to receive a second acoustic signal from the surroundings and provide a second audio signal. The signal processor 7 receives then the second audio signal and generates the output audio signal based on the first audio signal and the second audio signal. The anti-feedback unit 8 is in this specific example further configured to receive a secondary second audio signal from the second microphone 5B and the output audio signal and to estimate a second feedback response of a second feedback path 10B from the speaker 6 to the second microphone 5B based on a second feedback estimate, the secondary second audio signal and the output audio signal. The anti-feedback unit 7 is further configured to receive a secondary first audio signal from the first microphone 5A, and the anti-feedback unit 7 is further configured to estimate a first feedback response of the feedback path 10A from the speaker to the first microphone 5A based on a feedback estimate and the received secondary first audio signal and the output audio signal.

The self-checking unit 9 is positioned within the housing part 2 of the hearing aid device 1A.

In another example, the self-checking unit 9 may be positioned within a mobile device, a server or a computer.

Figure 3:
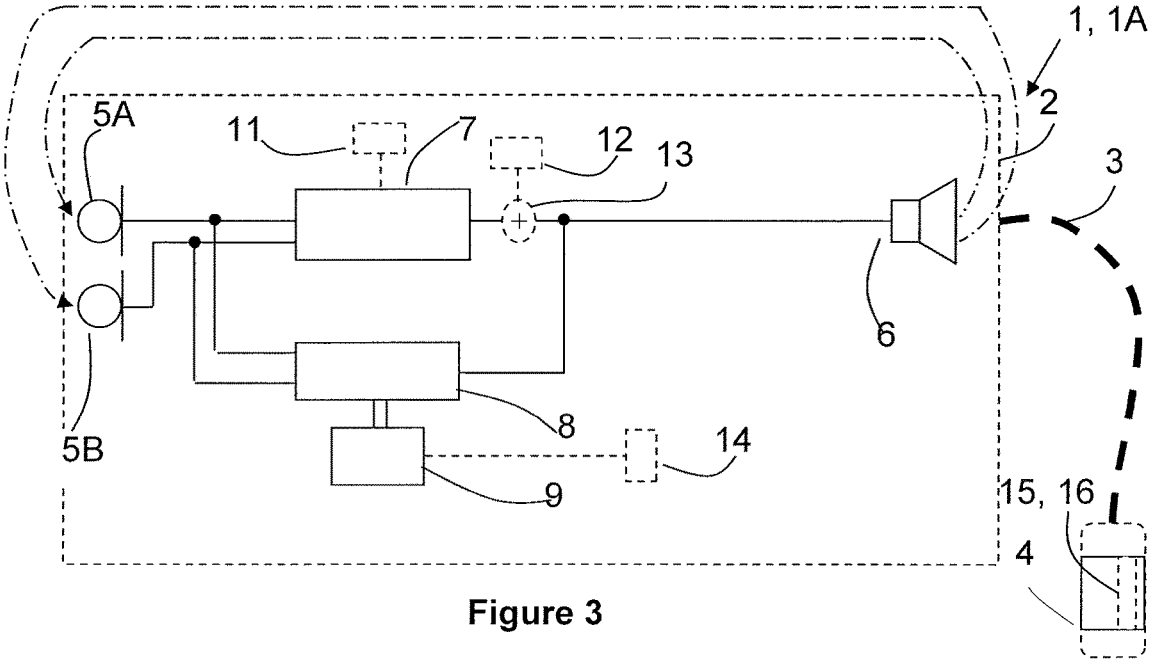
FIG. 3, illustrates the hearing system comprising the hearing aid device.

FIG. 3 illustrates the hearing system 1 comprising the hearing aid device 1A. In this specific example, the hearing aid device 1A comprises a signal generator 12 configured to provide a generated audio signal, and a combiner 13 connected to the signal generator 12 and the signal processor 7. The combiner 13 is configured to combine the generated audio signal into the output audio signal, and where the output audio signal is transmitted to the anti-feedback unit 8.

Alternatively, the hearing aid device 1A may include a user interface 14 which in this example is connected to the self-checking unit 9. Alternatively, the user interface 14 may be connected to the signal processor 7. The user interface 14 may be positioned within a mobile device, a server or a computer. The user interface 14 may be a display, light diodes, or part of the speaker 6.

Alternatively, the ear piece 4 of the hearing aid device 1A may include a wax filter 15 in front of a speaker 6 and/or the first microphone (5,5A). The ear piece may include a vent 16.

Figure 4A:
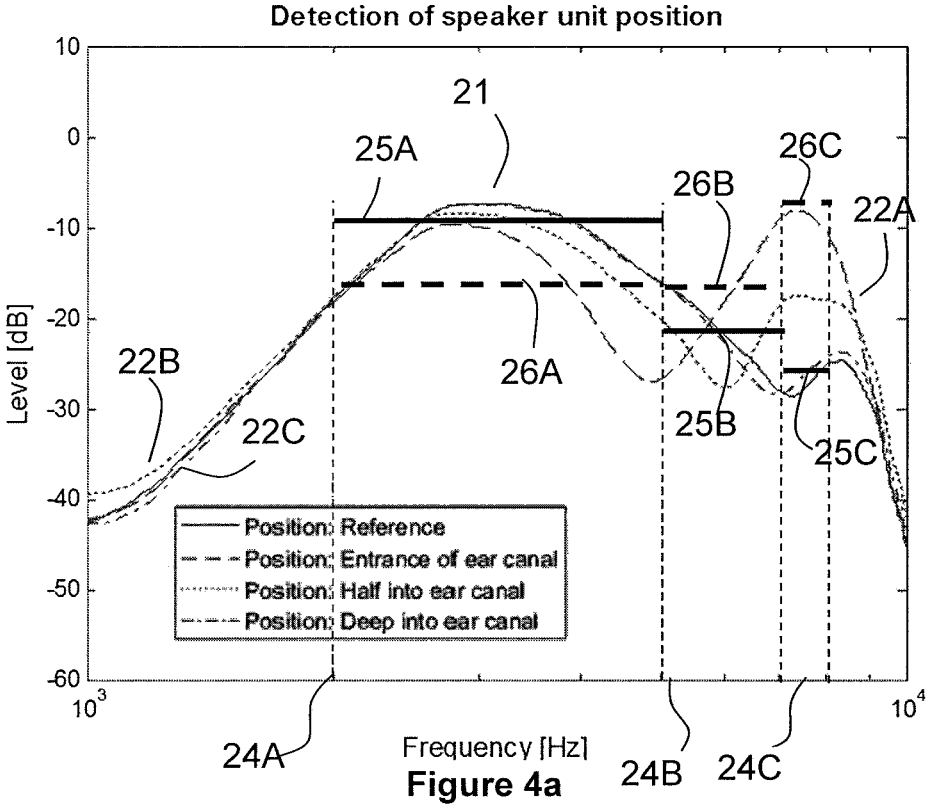
FIGS. 4*a* to 4*b*, illustrates measured feedback input signals and measured feedback responses.
Figure 4B:
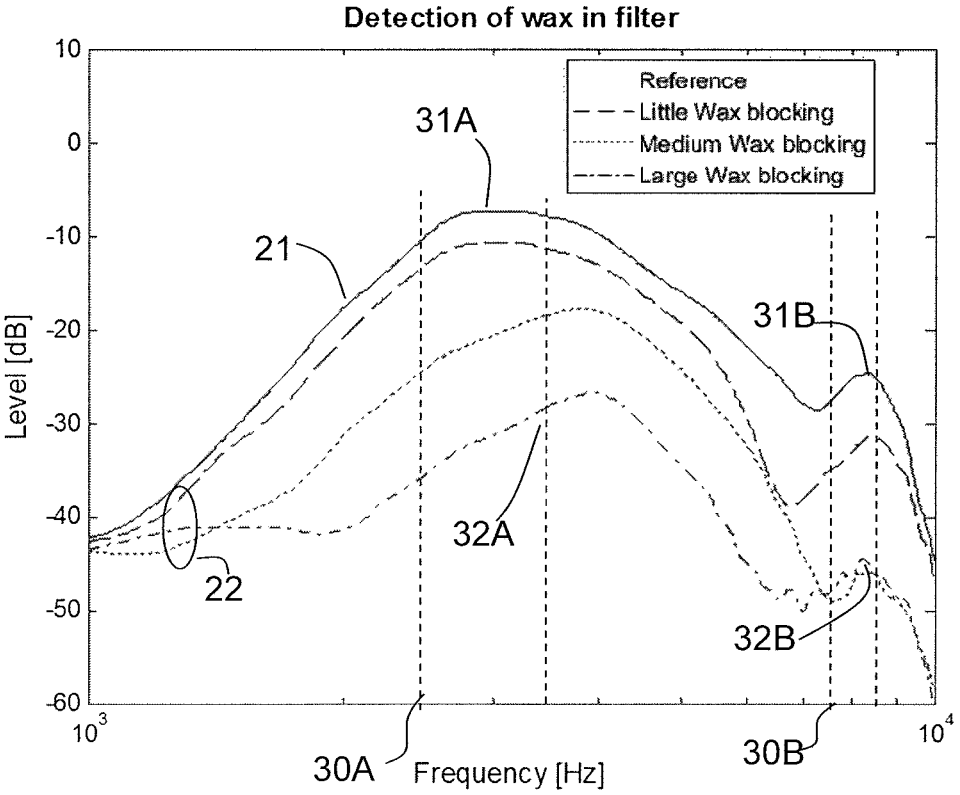

FIGS. 4*a* to 4*b* illustrates measured feedback input signals 21 and measured feedback responses (22, 22*a*, 22B, 22C, 22D) in power level as a function of frequency, where each FIGS. 4*a* and 4*b* illustrates different examples on status of features in the hearing aid device 1A.

FIG. 4*a* illustrates an example where the problem is to provide a status on whether the ear piece 4 is positioned correctly within the ear canal of the user of the hearing aid device 1A.

In this specific example the first feedback input signal 21 is measured from 1 kHz to 10 kHz when the ear piece 4 is positioned in the ear canal at an ideal position, and the first feedback response 22 has been measured at three different positions of the ear piece 4 in the ear canal. The dashed line 22A represents a measure of the first feedback response 22 when the ear piece is positioned at the entrance of the ear canal. The square-dotted line 22B represents a measure of the first feedback response 22 when the ear piece is positioned half into the ear canal, and the dash-dotted line 22C represents a measure of the first feedback response 22 when the ear piece is positioned deep into the ear canal.

The comparing between the first feedback response 22A, which in this example is measured when the ear piece 4 is positioned at the entrance of the ear canal, and the first feedback input signal 21 is performed by the self-checking unit 9. The comparing including;

- determining within a first frequency range 24A a first average signal level 26A of the signal level of the first feedback response 22A, and a first average reference level 25A of the signal level of the first feedback input signal 21,
- determining within a second frequency range 24B a second average signal level 26B of the signal level of the first feedback response 22A and a second average reference level 25B of the signal level of the first feedback input signal 21,
- determining within a third frequency range 24C a third average signal level 26C of the signal level of the first feedback response 22A and a third average reference level 25C of the signal level of the first feedback input signal 21,
- determining a first absolute signal level difference 27A between the first average signal 26A and the first average reference level 25B,
- determining a second absolute signal level difference 27B between the second average signal 26B and the second average reference level 25B, and
- determining a third absolute signal level difference 27C between the third average signal 26C and the third average reference level 25C.

If following conditions are meet, then the position of the ear piece is correct;

- first condition: the second absolute signal level difference 27B is between 0 dB and 2 dB or between 0 dB and 4 dB, and
- Second condition: the first absolute signal level difference 27A and the third absolute signal level difference 27C are both between 2 dB and 10 dB, 3 dB and 10 dB or 2 dB and 9 dB, and
- Third condition; the first frequency range 24A is between 2 and 5 kHz, the second frequency range 24B is between 5 and 7 kHz and the third frequency range 24C is between 7 and 8 kHz.

As described previously the comparing is performed by the self-checking unit 9, and the status of the positon of the ear piece 4 is provided to the user via a user interface 14.

FIG. 4*b* illustrates an example where the problem is to provide a status on whether the wax filter 15 or inlet 16 is blocked. In this specific example the first feedback input signal 21 is measured from 1 kHz to 10 kHz when the wax filter 15 and/or the inlet 16 is clean, and the first feedback response 22 has been measured when the wax filter 15 comprises a little amount of wax, more amount of wax, and when the wax filter 15 comprises a large amount of wax compared to the little amount. The dashed line represents a measure of the first feedback response 22 when the wax filter 15 comprises a little amount of wax. The square-dotted line represents a measure of the first feedback response 22 when the wax filter 15 comprises more amount of wax compared to the little amount of wax. The dash-dotted line represents a measure of the first feedback response 22 when the wax filter 15 comprises a larger amount of wax compared to the little amount of wax.

The comparing between the first feedback response 22, where the amount of wax in the wax filter 15 is large, and the first feedback input signal 21 is performed by the self-checking unit 9. The comparing including;

- determining within a first frequency range 30A a first maximum signal level 32A of the signal level of the first feedback response 22 and a first maximum reference level 31A of the signal level of the first feedback input signal 21,
- determining within a second frequency range 30B a second maximum signal level 32B of the signal level of the first feedback response 22 and a second maximum reference level 31B of the signal level of the first feedback input signal 21,
- determining a first signal level difference 33A between the first maximum signal level 32A and the first maximum reference level 31A,
- determining a second signal level difference 33B between the second maximum signal level 32B and the second maximum reference level 31B.

If following conditions are meet, then the amount of wax is ok:

- the first signal level difference 33A may be greater than −2 dB, −4 dB or −6 dB,
- the second level difference 33B may less than −3 dB, −5 dB or −7 dB, and
- the first frequency range 30A may be between 2.5 kHz and 3.5 kHz, and the second frequency range 30B may be between 7.5 kHz and 8.5 kHz.

FIGS. 5*a* to 5*d* illustrate measured feedback input signals 21 and feedback responses 22 in power level as a function of frequency. Each figure illustrates different measured feedback input signals 21 and feedback responses 22 of the purpose of providing a status on whether one of microphone inlets 16 are blocked, partly blocked or not blocked with wax and/or dirt. In this example, the hearing aid device 1A comprises a second microphone 5B configured to receive a second acoustic signal and provide a second audio signal. The signal processor 7 is then configured to receive the second audio signal, and the signal processor 7 is further configured to provide the output audio signal based on the first audio signal and the second audio signal, and the anti-feedback unit 8 is further configured to receive a secondary second audio signal from the second microphone 5B and the output audio signal and to estimate a second feedback response of a second feedback path 10B from the speaker 6 to the second microphone 5B based on a second feedback estimate, the secondary second audio signal and the output audio signal. In this example the second feedback response is the first feedback input signal, to be used to detect weather the rear microphone is blocked To test if the front microphone (second feedback signal) is blocked then the first feedback response is the first input signal.

The feedback unit 8 is configured to estimate the first feedback response and/or the second feedback response continuously. Thereby, the ratio between the measured feedback responses will not change due to lack of power from the battery, and which leads to a more reliable measurement of the ratio between the feedback responses. This will improve the hearing aid device 1A's ability to give a more precise estimation on the status of the wax filter 15 or an inlet 16 to one of the microphones (5A, 5B) position in the housing part 2.

FIGS. 5*a* to 5*d* illustrate measured feedback input signals 21 and feedback responses 22 in power level as a function of frequency where the housing part 2 comprising a front microphone 5A and a rear microphone 5B, and where the housing 2 has an inlet 16 in the shell of the housing and which guides acoustic waves from surroundings to the microphone (5A, 5B). The inlet 16 may have a filter to prevent dust or dirt to reach the microphones (5A, 5B). The solid line represents the second feedback response of the feedback path 10B between the speaker 6 and the front microphone 5B (being the second microphone 5B) positioned in the housing part 2, and the dashed line represents the first feedback response of the feedback path 10A between the speaker 6 and the rear microphone 5A (being the first microphone 5A) positioned in the housing part 2.

The self-checking unit 9 is configured to perform the comparing between the first feedback response 22, being the feedback response between the speaker 6 and the rear microphone 5A, and the first feedback input signal 21, being the feedback response between the speaker 6 and the front microphone 5B. The comparing including;

- determining within a first frequency range 40 a first maximum signal level 42A of the signal level of the first feedback response 22 and a first maximum reference level 41A of the signal level of the first feedback input signal 21,
- determining within a second frequency range 40 a second maximum signal level 42B of the signal level of the first feedback response 22 and a second maximum reference level 41B of the signal level of the first feedback input signal 21,
- determining a first signal level difference 43A as the first maximum signal level 42A minus the first maximum reference level 41A,
- determining a second signal level difference 43B as the second maximum signal level 42B minus the second maximum reference level 41B.

If following conditions are meet, then the inlet is not to be cleaned or changed:

- the first signal level difference 43A and the second signal level difference 43B may be greater than −8 dB, −9 dB or −12 dB,
- the second level difference 43B is greater than −14 dB, −15 dB or −22 dB
- the first frequency range 40A may be between 2.5 kHz and 3.5 kHz, and
- the second frequency range 40B may be between 7.5 kHz and 8.5 kHz.

Figure 5A:
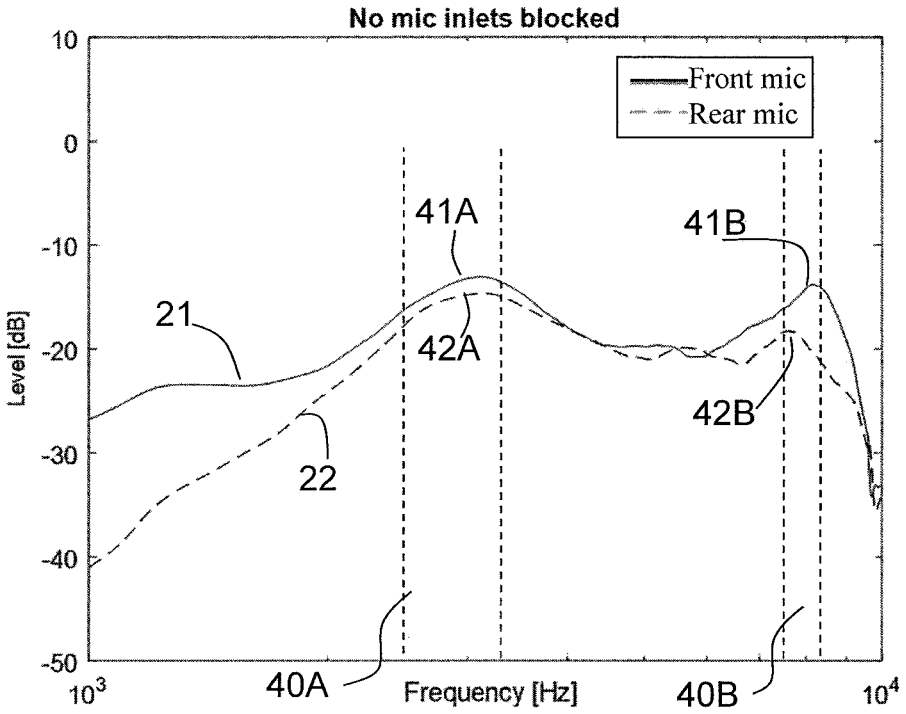
FIGS. 5*a* to 5*d*, illustrates measured feedback input signals and measured feedback responses.

FIG. 5*a* illustrates an example where the inlet to each microphone is not blocked. The criteria defined above is fulfilled. Within the first frequency range 40A the first absolute signal level difference 43A is greater than −8 dB, and within the second frequency range 40B the first absolute signal level difference 43B is greater than −14 dB. Thereby, in this specific example, the inlet is ok.

Figure 5B:
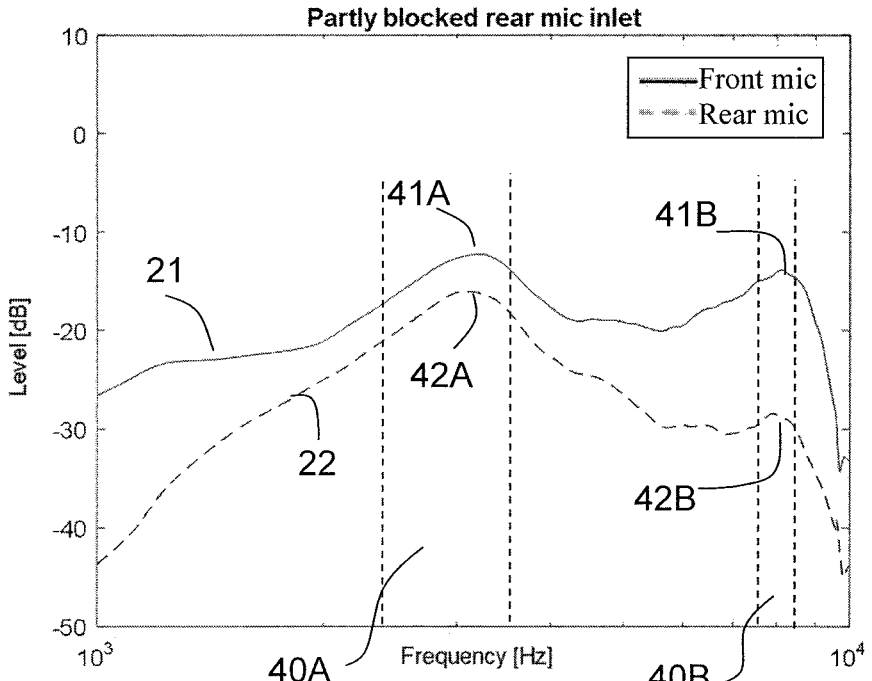

FIG. 5*b* illustrates an example where the inlet is partly blocked. The criteria defined above is fulfilled. Within the first frequency range 40A the first signal level difference 43A is greater than −8 dB, and within the second frequency range 40B the first absolute signal level difference 43B is greater than −15 dB. Thereby, in this specific example, the inlet is ok.

Figure 5C:
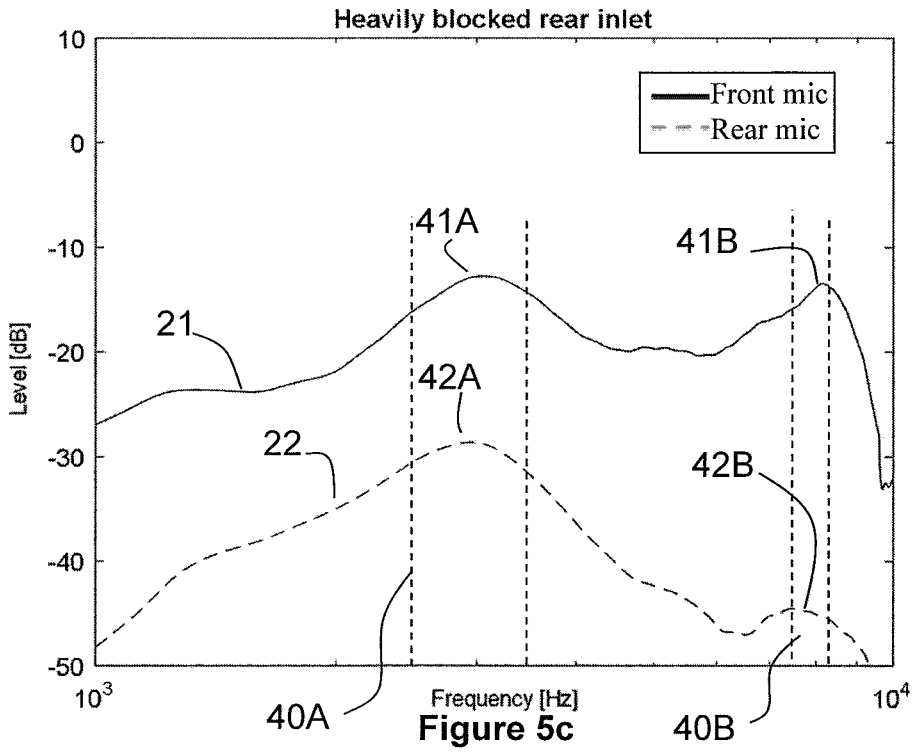

FIG. 5*c* illustrates an example where the inlet is heavily blocked. The criteria defined above is not fulfilled. Within the first frequency range 40A the first signal level difference 43A is not greater than −12 dB, and within the second frequency range 40B the first signal level difference 43B is not greater than −22 dB. Thereby, in this specific example, the inlet is not ok and has to be changed or cleaned.

Figure 5D:
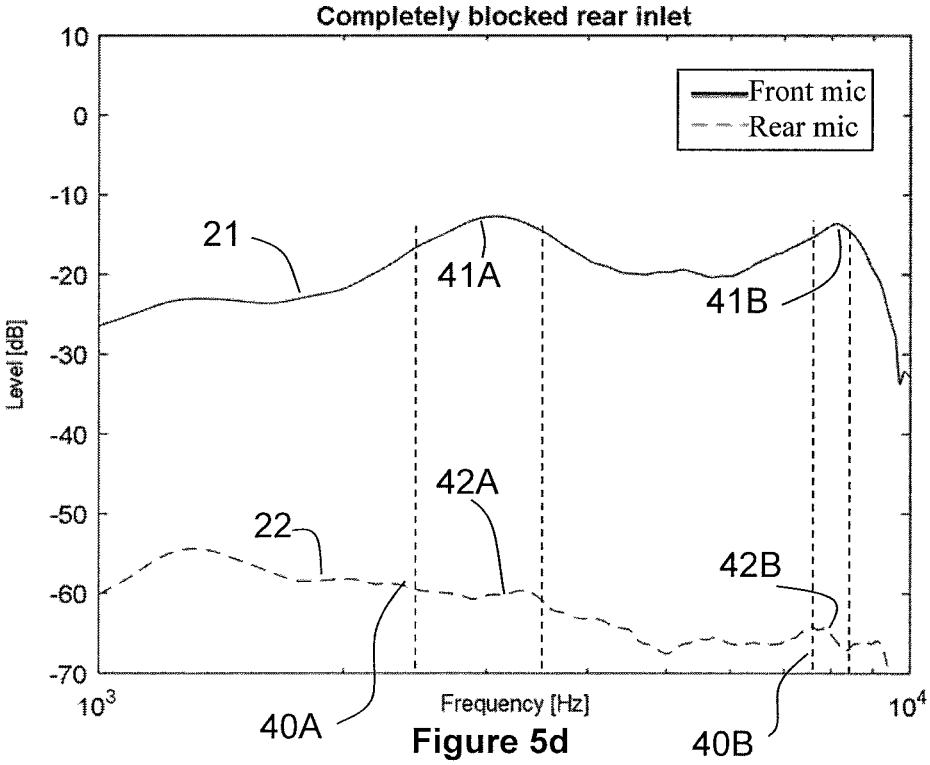

FIG. 5*d* illustrates an example where the inlet is completely blocked. The criteria defined above is again not fulfilled. Within the first frequency range 40A the first signal level difference 43A is not greater than −12 dB, and within the second frequency range 40B the first signal level difference 43B is not greater than −22 dB. Thereby, in this specific example, the inlet is not ok and has to be changed or cleaned.

Figure 6:
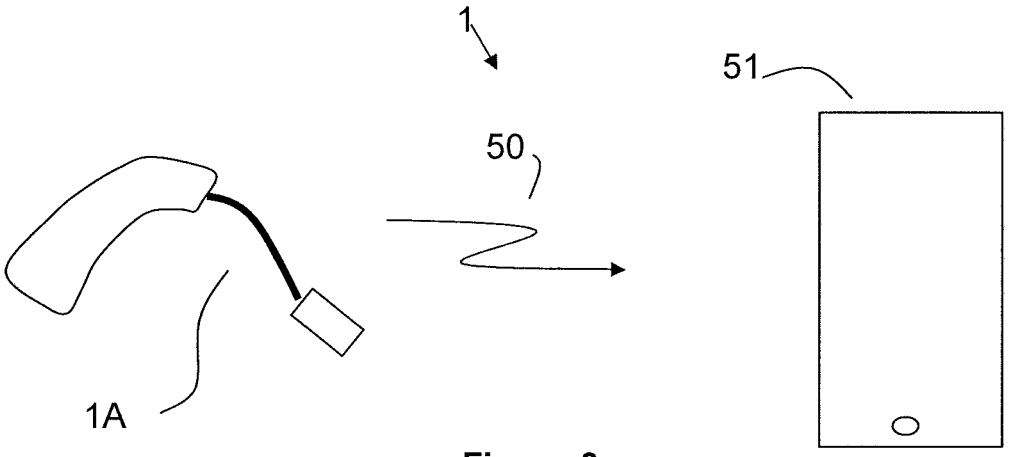
FIG. 6, illustrates an example of the hearing system.

FIG. 6 illustrates an example of the hearing system 1 comprising the hearing aid device 1A, a wireless link 50, and a mobile device 51, wherein the wireless link 50 is connecting the hearing aid device 1A to the mobile device 51. The hearing aid device 1A comprises the self-checking unit 9, and the hearing aid device 1A is in this example configured to communicate via the wireless link 51 an information signal comprising a status of one or more features of the hearing aid device to a user interface 14 of the mobile device 51.

Figure 7:
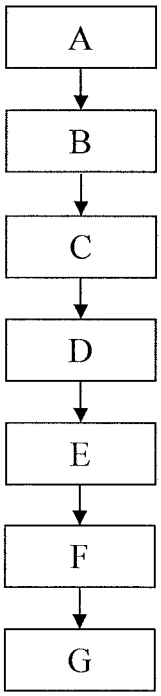
FIG. 7, illustrates a flowchart of the method for determining a status of one or more features in a hearing aid device.

FIG. 7 illustrates a flowchart of the method for determining a status of one or more features in a hearing aid device, the method comprising;

receiving (A) a first acoustic signal via a first microphone and outputting a first audio signal based on the first acoustic signal, processing (B) the first audio signal via a signal processor and providing an output audio signal based on the first audio signal, receiving (C) the output audio signal via a speaker and outputting an acoustic output signal based on the output audio signal, receiving (D) the output audio signal from the processor and a secondary first audio signal from the first microphone, estimating (E) a first feedback response of a feedback path from the speaker to the first microphone based on a feedback estimate and the received secondary first audio signal and the output audio signal, comparing (F) the first feedback response with a first feedback input signal, determining (G) a status of the configuration of the hearing aid device based on the comparison between the first feedback response with the first feedback input signal.

The invention claimed is:

1. A hearing system including a hearing aid device, wherein the hearing aid device comprises a housing part, a connection part and an ear piece connected via the connection part to the housing part, and wherein the hearing aid device comprises:

a first microphone configured to receive a first acoustic signal and provide a first audio signal based on the first acoustic signal, a signal processor connected to the first microphone and configured to receive the first audio signal and provide an output audio signal based on the first audio signal, a speaker configured to receive the output audio signal and output an acoustic output signal via the ear piece; and an anti-feedback unit configured to receive the output audio signal from the signal processor and a secondary first audio signal from the first microphone, and the anti- feedback unit is further configured to estimate a first feedback response of a feedback path from the speaker to the first microphone based on a feedback estimate and the received secondary first audio signal and the output audio signal, and wherein the hearing system includes a self-checking unit configured to communicate with the anti-feedback unit, and the self-checking unit is configured to compare the first feedback response with a first feedback input signal, and the hearing system is configured to determine a status of one or more features in the hearing aid device based on the comparison between the first feedback response and the first feedback input signal, wherein the ear piece comprises a vent characterized as having a vent internal response having a −3 dB cut-off frequency around or above 800 Hz, or between 800 HZ and 1600 HZ.

2. A hearing system according to claim 1, comprising a memory unit including the first feedback input signal, where the first feedback input signal is a pre-measure of a feedback response of the feedback path from the speaker to the first microphone.

3. A hearing system according to claim 1 A hearing system including a hearing aid device, wherein the hearing aid device comprises a housing part, a connection part and an ear piece connected via the connection part to the housing part, and wherein the hearing aid device comprises:

a first microphone configured to receive a first acoustic signal and provide a first audio signal based on the first acoustic signal;

a signal processor connected to the first microphone and configured to receive the first audio signal and provide an output audio signal based on the first audio signal, a speaker configured to receive the output audio signal and output an acoustic output signal via the ear piece; and an anti-feedback unit configured to receive the output audio signal from the signal processor and a secondary first audio signal from the first microphone, and the anti- feedback unit is further configured to estimate a first feedback response of a feedback path from the speaker to the first microphone based on a feedback estimate and the received secondary first audio signal and the output audio signal, wherein the hearing system includes a self-checking unit configured to communicate with the anti-feedback unit, and the self-checking unit is configured to compare the first feedback response with a first feedback input signal, and the hearing system is configured to determine a status of one or more features in the hearing aid device based on the comparison between the first feedback response and the first feedback input signal, and wherein the hearing aid device comprises a second microphone configured to receive a second acoustic signal and provide a second audio signal, the signal processor receives the second audio signal, the signal processor is further configured to provide the output audio signal based on the first audio signal and the second audio signal, the anti-feedback unit is further configured to receive a secondary second audio signal from the second microphone and the output audio signal and to estimate a second feedback response of a second feedback path from the speaker to the second microphone based on a second feedback estimate, the secondary second audio signal and the output audio signal, and where the second feedback response is the first feedback input signal.

4. A hearing system according to claim 1, wherein the hearing aid device further comprises:

a signal generator configured to provide a generated audio signal; and a combiner connected to the signal generator and the signal processor, the combiner being configured to combine the generated audio signal into the output audio signal, and where the output audio signal is transmitted to the anti-feedback unit.

5. A hearing system according to claim 1, wherein the hearing aid device comprises the self-checking unit, and wherein the hearing aid device is configured to communicate an information signal based on the comparing between the first feedback response and the first feedback input signal to a user interface of the hearing aid device, or the hearing system comprises a mobile device, wherein the information signal is communicated to the mobile device via a wireless link.

6. A hearing system according to claim 1, wherein the hearing system includes a mobile device, wherein the mobile device comprises the self-checking unit, and wherein the mobile device is configured to communicate an information signal comprising the status of one or more features in the hearing aid device to a user interface of the mobile device or to a user interface of the hearing aid device.

7. A hearing system according to claim 1, wherein the comparing between the first feedback response with the first feedback input signal includes determining within one or more frequency ranges or at one or more frequencies a signal level difference between the first feedback response and the first feedback input signal.

8. A hearing system according to claim 1, wherein the comparing between the first feedback response and the first feedback input signal including includes;

determining within a first frequency range a first average signal level of the signal level of the first feedback response and a first average reference level of the signal level of the first feedback input signal;

determining within a second frequency range a second average signal level of the signal level of the first feedback response and a second average reference level of the signal level of the first feedback input signal;

determining within a third frequency range a third average signal level of the signal level of the first feedback response and a third average reference level of the signal level of the first feedback input signal;

determining a first signal level difference between the first average signal and the first average reference level, level;

determining a second signal level difference between the second average signal and the second average reference level; and determining a third signal level difference between the third average signal and the third average reference level, and wherein the second absolute signal level difference is between 0 dB and 2 dB or 0 dB and 4 dB, and the first signal level difference and the third signal level difference are both between 2 dB and 10 dB, 3 dB and 10 dB, or 2 dB and 9 dB, and where the first frequency range is between 2 and 5 kHz, the second frequency range is between 5 and 7 kHz and the third frequency range is between 7 and 8 kHz.

9. A hearing system including a hearing aid device, wherein the hearing aid device comprises a housing part, a connection part and an ear piece connected via the connection part to the housing part, and wherein the hearing aid device comprises:

a first microphone configured to receive a first acoustic signal and provide a first audio signal based on the first acoustic signal;

a signal processor connected to the first microphone and configured to receive the first audio signal and provide an output audio signal based on the first audio signal, a speaker configured to receive the output audio signal and output an acoustic output signal via the ear piece; and an anti-feedback unit configured to receive the output audio signal from the signal processor and a secondary first audio signal from the first microphone, and the anti- feedback unit is further configured to estimate a first feedback response of a feedback path from the speaker to the first microphone based on a feedback estimate and the received secondary first audio signal and the output audio signal, and wherein the hearing system includes a self-checking unit configured to communicate with the anti-feedback unit, and the self-checking unit is configured to compare the first feedback response with a first feedback input signal, and the hearing system is configured to determine a status of one or more features in the hearing aid device based on the comparison between the first feedback response and the first feedback input signal, and wherein the comparing between the first feedback response and the first feedback input signal for providing a status on a wax filter provided into the ear piece or an inlet to the first microphone and to a second microphone provided into the housing part including; includes:

determining within a first frequency range a first maximum signal level of the signal level of the first feedback response and a first maximum reference level of the signal level of the first feedback input signal and/or the second feedback input signal, determining within a second frequency range a second maximum signal level of the signal level of the first feedback response and a second maximum reference level of the signal level of the first feedback input signal and/or the second feedback input signal, determining a first signal level difference between the first maximum signal level and the first maximum reference level, and determining a second signal level difference between the second maximum signal level and the second maximum reference level.

10. A hearing system according to claim 9, wherein the first signal level difference is greater than −2, −4 or −6 dB and the second level difference is greater than −3, −5 or −7 dB, and the first frequency range is between 2.5 kHz and 3.5 kHz, and the second frequency range is between 7.5 kHz and 8.5 kHz, and where the status of the wax filter is ok.

11. A hearing system according to claim 3, comprising a memory unit including the first feedback input signal, where the first feedback input signal is a pre-measure of a feedback response of the feedback path from the speaker to the first microphone.

12. A hearing system according to claim 1, wherein the hearing aid device comprises a second microphone configured to receive a second acoustic signal and provide a second audio signal, and the signal processor receives the second audio signal, and the signal processor is further configured to provide the output audio signal based on the first audio signal and the second audio signal,-and the anti-feedback unit is further configured to receive a secondary second audio signal from the second microphone and the output audio signal and to estimate a second feedback response of a second feedback path from the speaker to the second microphone based on a second feedback estimate, the secondary second audio signal and the output audio signal, and where the second feedback response is the first feedback input signal.

13. A hearing system according to claim 3, wherein the hearing aid device comprising;

a signal generator configured to provide a generated audio signal; and a combiner connected to the signal generator and the signal processor, and the combiner is configured to combine the generated audio signal into the output audio signal, and where the output audio signal is transmitted to the anti-feedback unit.

14. A hearing system according to claim 9, wherein the hearing aid device comprises:

a signal generator configured to provide a generated audio signal; and a combiner connected to the signal generator and the signal processor, and the combiner is configured to combine the generated audio signal into the output audio signal, and where the output audio signal is transmitted to the anti-feedback unit.

15. A hearing system according to claim 2, wherein the hearing aid device comprising;

a signal generator configured to provide a generated audio signal; and a combiner connected to the signal generator and the signal processor, and the combiner is configured to combine the generated audio signal into the output audio signal, and where the output audio signal is transmitted to the anti-feedback unit.

16. A hearing system according to claim 3, wherein the hearing aid device comprises the self-checking unit, and wherein the hearing aid device is configured to communicate an information signal based on the comparing between the first feedback response and the first feedback input signal to a user interface of the hearing aid device, or the hearing system comprises a mobile device, wherein the information signal is communicated to the mobile device via a wireless link.

17. A hearing system according to claim 9, wherein the hearing aid device comprises the self-checking unit, and wherein the hearing aid device is configured to communicate an information signal based on the comparing between the first feedback response and the first feedback input signal to a user interface of the hearing aid device, or the hearing system comprises a mobile device, wherein the information signal is communicated to the mobile device via a wireless link.

* * * * *